US006609260B2

(12) United States Patent
Hand et al.

(10) Patent No.: US 6,609,260 B2
(45) Date of Patent: Aug. 26, 2003

(54) PRONING BED AND METHOD OF OPERATING THE SAME

(75) Inventors: Barry D. Hand, Mt. Pleasant, SC (US); Dana H. Delk, North Charleston, SC (US); Jack J. Brooks, Folly Beach, SC (US); Stephen J. Doehler, Charleston, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 46 days.

(21) Appl. No.: 09/810,376

(22) Filed: Mar. 16, 2001

(65) Prior Publication Data

US 2002/0016994 A1 Feb. 14, 2002

Related U.S. Application Data

(60) Provisional application No. 60/190,367, filed on Mar. 17, 2001.

(51) Int. Cl.[7] ..... A47B 7/00; A47C 27/08

(52) U.S. Cl. ..... 5/600; 5/607; 5/609; 5/615; 5/713

(58) Field of Search ..... 5/600, 607, 609, 5/615, 613, 713, 706, 710

(56) References Cited

U.S. PATENT DOCUMENTS

| | | | |
|---|---|---|---|
| 1,021,335 | A | 3/1912 | Robinson |
| 1,573,571 | A | 2/1926 | Pohl |
| 1,667,982 | A | 5/1928 | Pearson |
| 1,799,692 | A | 4/1931 | Knott |
| 2,076,675 | A | 4/1937 | Sharp |
| 2,239,821 | A | 4/1941 | Knox |
| 2,311,542 | A | 2/1943 | Holme |
| 2,417,378 | A | 3/1947 | Robinson |
| 2,499,101 | A | 2/1950 | Kluglein |
| 2,607,103 | A | 8/1952 | Davidson |
| 2,613,371 | A | 10/1952 | Keyes, Jr. |
| 2,639,206 | A | 5/1953 | Butler |
| 2,667,169 | A | 1/1954 | Kambourakis |
| 2,673,987 | A | 4/1954 | Upshaw et al. |
| 2,803,022 | A | 8/1957 | Wynkoop |
| 2,880,720 | A | 4/1959 | Houghtaling |
| 2,902,701 | A | 9/1959 | Driskill |
| 3,049,726 | A | 8/1962 | Getz |
| 3,110,912 | A | 11/1963 | Propst |
| 3,200,416 | A | 8/1965 | Warrick |
| 3,206,188 | A | 9/1965 | Douglass, Jr. |
| 3,226,734 | A | 1/1966 | Coventon |
| 3,238,539 | A | 3/1966 | Koch |
| 3,286,707 | A | 11/1966 | Shafer |
| 3,302,218 | A | 2/1967 | Stryker |

(List continued on next page.)

FOREIGN PATENT DOCUMENTS

| | | | |
|---|---|---|---|
| EP | 0025701 | * | 3/1981 |
| EP | 0 569 308 A1 | | 5/1993 |
| FR | 2.034.679 | | 12/1970 |
| FR | 2 247 194 | | 5/1975 |
| FR | 2 549 366 | | 1/1985 |
| FR | 2 585 240 | | 1/1987 |
| FR | 2 749 503 | | 12/1997 |
| TW | 77886 | | 11/1975 |
| WO | WO 93/05745 | | 9/1992 |
| WO | WO 97/22323 | | 6/1997 |
| WO | WO 98/39996 | | 9/1998 |
| WO | 9907320 | * | 2/1999 |
| WO | WO 99/07320 | | 2/1999 |
| WO | WO 99/53997 | | 10/1999 |
| WO | 200000117 | * | 1/2000 |

*Primary Examiner*—Jong-Suk James Lee
(74) *Attorney, Agent, or Firm*—Bose McKinney & Evans LLP

(57) ABSTRACT

A bed comprises a fluid supply and a bed support coupled to the fluid supply. A patient support surface is configured to couple to the bed support.

46 Claims, 5 Drawing Sheets

U.S. PATENT DOCUMENTS 3,344,445 A 10/1967 Crawford
3,388,700 A 6/1968 Mountz
3,434,165 A 3/1969 Keane
3,451,070 A 6/1969 Danielson
3,499,529 A 3/1970 Katzfey et al.
3,584,321 A 6/1971 Buchanan
3,653,079 A 4/1972 Bourgraf et al.
3,658,052 A 4/1972 Alter
3,667,075 A * 6/1972 Ballard et al. ..... 5/615 X
3,737,924 A 6/1973 Davis
3,739,406 A 6/1973 Koetter
3,748,666 A 7/1973 Seng
3,752,153 A 8/1973 Copeland
3,765,406 A 10/1973 Toole et al.
3,783,863 A 1/1974 Kliever
3,814,414 A 6/1974 Chapa
3,820,176 A 6/1974 Feiertag
3,827,089 A 8/1974 Grow
3,828,377 A 8/1974 Eary, Sr.
3,832,742 A 9/1974 Stryker
3,851,644 A 12/1974 Slagle
3,868,103 A 2/1975 Pageot et al.
3,874,010 A 4/1975 Geary
3,884,225 A 5/1975 Witter
3,902,204 A 9/1975 Lee
3,905,591 A 9/1975 Schorr et al.
3,940,808 A 3/1976 Petrini
3,941,365 A 3/1976 Frymoyer
4,054,960 A * 10/1977 Pettit et al. ..... 5/710 X
4,071,916 A 2/1978 Nelson
4,080,673 A 3/1978 Weisler
4,084,274 A 4/1978 Willis et al.
4,109,329 A 8/1978 Tupper
4,152,795 A 5/1979 Rodosta et al.
4,156,815 A 5/1979 Hogan
4,175,550 A 11/1979 Leininger et al.
4,183,110 A 1/1980 Kidd et al.
4,195,829 A 4/1980 Reser
4,244,358 A 1/1981 Pyers
4,274,167 A 6/1981 Immel
4,277,857 A 7/1981 Svehaug
4,356,577 A 11/1982 Taylor et al.
4,384,378 A 5/1983 Getz et al.
4,395,786 A 8/1983 Casey et al.
4,432,353 A 2/1984 Vrzalik
4,490,867 A 1/1985 Gabrielsson
4,535,762 A 8/1985 Natchev
4,557,471 A 12/1985 Pazzini
4,558,857 A 12/1985 Heller
4,572,493 A 2/1986 Hubert
4,578,833 A 4/1986 Vrzalik
4,584,989 A 4/1986 Stith
4,586,492 A 5/1986 Manahan
4,619,270 A 10/1986 Margolis et al.
4,638,516 A 1/1987 Vrzalik
4,655,206 A 4/1987 Moody
4,658,450 A 4/1987 Thompson
4,685,159 A 8/1987 Oetiker
4,763,643 A 8/1988 Vrzalik
4,769,584 A 9/1988 Irigoyen et al.
4,827,541 A 5/1989 Vollman et al.
4,841,585 A 6/1989 Masuzawa
4,847,929 A 7/1989 Pupovic
4,852,193 A 8/1989 Alsip et al.
4,856,128 A 8/1989 Alsip et al.
4,866,796 A 9/1989 Robinson et al.
4,868,937 A 9/1989 Connolly
4,872,657 A 10/1989 Lussi
4,873,731 A * 10/1989 Williamson ..... 5/615
4,895,173 A 1/1990 Brault et al.
4,912,754 A 3/1990 Van Steenburg
4,920,589 A 5/1990 LaVelle et al.
4,924,537 A 5/1990 Alsip et al.
4,939,801 A 7/1990 Schaal et al.
4,941,221 A 7/1990 Kanzler
4,944,054 A 7/1990 Bossert
4,947,496 A 8/1990 Connolly
4,958,817 A 9/1990 Heller et al.
4,960,271 A 10/1990 Sebring
4,987,622 A 1/1991 Shockey
5,005,233 A 4/1991 Toivio et al.
5,018,712 A 5/1991 Schaefer
5,020,170 A 6/1991 Ruf
5,023,968 A 6/1991 Diehl et al.
5,048,071 A 9/1991 Van Steenburg
5,060,324 A 10/1991 Marinberg et al.
5,062,171 A * 11/1991 Vrzalik ..... 5/713
5,088,706 A 2/1992 Jackson
5,092,007 A 3/1992 Hasty
5,103,511 A 4/1992 Sequin
5,131,103 A 7/1992 Thomas et al.
5,131,105 A 7/1992 Harrawood et al.
5,131,106 A 7/1992 Jackson
5,148,815 A 9/1992 Britton
5,152,024 A 10/1992 Chrones et al.
5,181,288 A 1/1993 Heaton et al.
5,208,928 A 5/1993 Kuck et al.
5,230,112 A 7/1993 Harrawood et al.
5,230,113 A 7/1993 Foster et al.
5,249,318 A * 10/1993 Loadsman ..... 5/710
5,274,862 A 1/1994 Palmer, Jr. et al.
5,299,334 A 4/1994 Gonzalez
5,319,817 A 6/1994 Hay et al.
5,334,186 A 8/1994 Alexander
5,345,630 A * 9/1994 Healy ..... 5/615 X
5,398,356 A 3/1995 Pfleger
5,404,603 A 4/1995 Fukai et al.
5,412,823 A 5/1995 Sitta
5,418,990 A 5/1995 Risasen
5,427,338 A 6/1995 Garrett et al.
5,435,323 A 7/1995 Rudy
5,502,853 A 4/1996 Singleton et al.
5,515,561 A 5/1996 Suggitt et al.
5,515,869 A 5/1996 Powell et al.
5,621,932 A 4/1997 Strachan
5,621,933 A 4/1997 Knapp et al.
5,664,270 A 9/1997 Bell et al.
5,699,568 A 12/1997 Couldridge
5,790,996 A 8/1998 Narfstrom
5,860,899 A 1/1999 Rassman
5,864,901 A * 2/1999 Blumel ..... 5/600 X
5,966,762 A 10/1999 Wu
6,065,165 A 5/2000 Delk et al.
6,108,838 A 8/2000 Connolly et al.
6,112,349 A 9/2000 Connolly
6,119,292 A * 9/2000 Haas ..... 5/713 X
6,240,584 B1 * 6/2001 Perez et al. ..... 5/713
6,260,220 B1 7/2001 Lamb et al.
6,282,736 B1 9/2001 Hand et al.
6,327,727 B1 * 12/2001 Bocharnikov ..... 5/713
6,353,949 B1 3/2002 Falbo
6,385,801 B1 5/2002 Watanabe et al.
2002/0026671 A1 3/2002 Hand et al.

* cited by examiner

PRONING BED AND METHOD OF OPERATING THE SAME

This application claims the benefit of U.S. Provisional Application Serial No. 60/190,367, filed on Mar. 17, 2001, which is incorporated herein by reference.

BACKGROUND OF THE INVENTION

The present invention relates to a hospital bed. More particularly, the present invention relates the a bed for providing rotational therapy or proning a patient on the bed.

It is known to rotate a patient on a patient support assembly 180° to prone the patient to, for example, perform certain surgical procedures on the spine or to permit the patient to lie face down on a support surface. It is also known to rotate the patient a full 360° about a longitudinal axis to position the patient for an operation. See, for example, U.S. Pat. No. 5,418,990 to Risasen. In addition, it is known to rotate a patient support surface from a generally horizontal position to a generally vertical position as disclosed in, for example, U.S. Pat. No. 5,412,823 to Sitta.

In an illustrated embodiment of the present invention, a bed comprises a fluid supply, a bed support coupled to the fluid supply, and a patient support surface configured to couple to and be separated from the bed support. The patient support surface is in communication with the fluid supply automatically when the patient support surface is coupled to the bed support.

Also in the illustrated embodiment, the bed further comprises a mover configured to rotate the patient support surface about a longitudinal axis of the patient support surface. The patient support surface illustratively includes a mattress and the fluid supply is in communication with the mattress when the patient support surface is coupled to the bed support.

Also in an illustrated embodiment, the bed support includes a body portion and a support plate movably coupled to the body portion. In this embodiment, the patient support surface is coupled to the support plate and a plurality of fluid supply hoses are coupled between the body portion and the support plate to supply fluid to the patient support surface.

Also in an illustrated embodiment, the bed support further includes a base, a cradle coupled to the base, and a plurality of bearings coupled to the cradle to support the body portion. A mover is illustratively configured to rotate the body portion, the support plate, and the patient support surface about a longitudinal axis of the patient support surface.

In the illustrated embodiment, the bed further comprises an anterior bed support including an anterior body portion, an anterior support plate coupled to the anterior body portion, and a proning support surface coupled to the anterior support plate. The proning support surface includes a mattress coupled to the fluid supply through the anterior body portion and the anterior support plate.

In another illustrated embodiment, a bed comprises a patient support surface, a bed support, and a fluid supply coupled to the bed support. The bed further comprises means for releasably coupling the patient support surface and the bed support so that the fluid supply is in communication with the patient support surface when the patient support surface is coupled to the bed support.

In yet another illustrated embodiment, a bed comprises a fluid supply, a posterior bed support, an anterior bed support coupled to the posterior bed support, the anterior bed support including a mattress, and a patient support surface coupled to the posterior bed support. The patient support surface and the mattress of the anterior bed support are in communication with the fluid supply when the patient support surface is coupled to the posterior bed support.

In still another illustrated embodiment, a bed comprises a posterior bed support including a passageway having an inlet and an outlet and a patient support surface coupled to the posterior bed support. The patient support surface includes a mattress that is in communication with the outlet of the passageway of the posterior bed support when the patient support surface is coupled to the posterior bed support. The bed also includes an anterior bed support coupled to the posterior bed support. The anterior bed support includes a passageway and a mattress in communication with the passageway. The passageways of the anterior and posterior bed supports are in communication when the anterior bed support is coupled to the posterior bed support. The bed further comprises a fluid supply coupled to the inlet of the passageway of the posterior bed support.

In a further illustrated embodiment, a method is provided for handling a patient on a proning bed. The method comprises providing a proning bed having a bed support and first and second mattresses. The first mattress is inflatable, and the patient lies on the first mattress in a supine position. The method also comprises coupling the first mattress to the bed support, inflating the first mattress, coupling the second mattress to the bed support, and moving the first and second mattresses so that the patient is lying on the second mattress in a prone position.

Additional features of the invention will become apparent to those skilled in the art upon consideration of the following detailed description of an illustrative embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
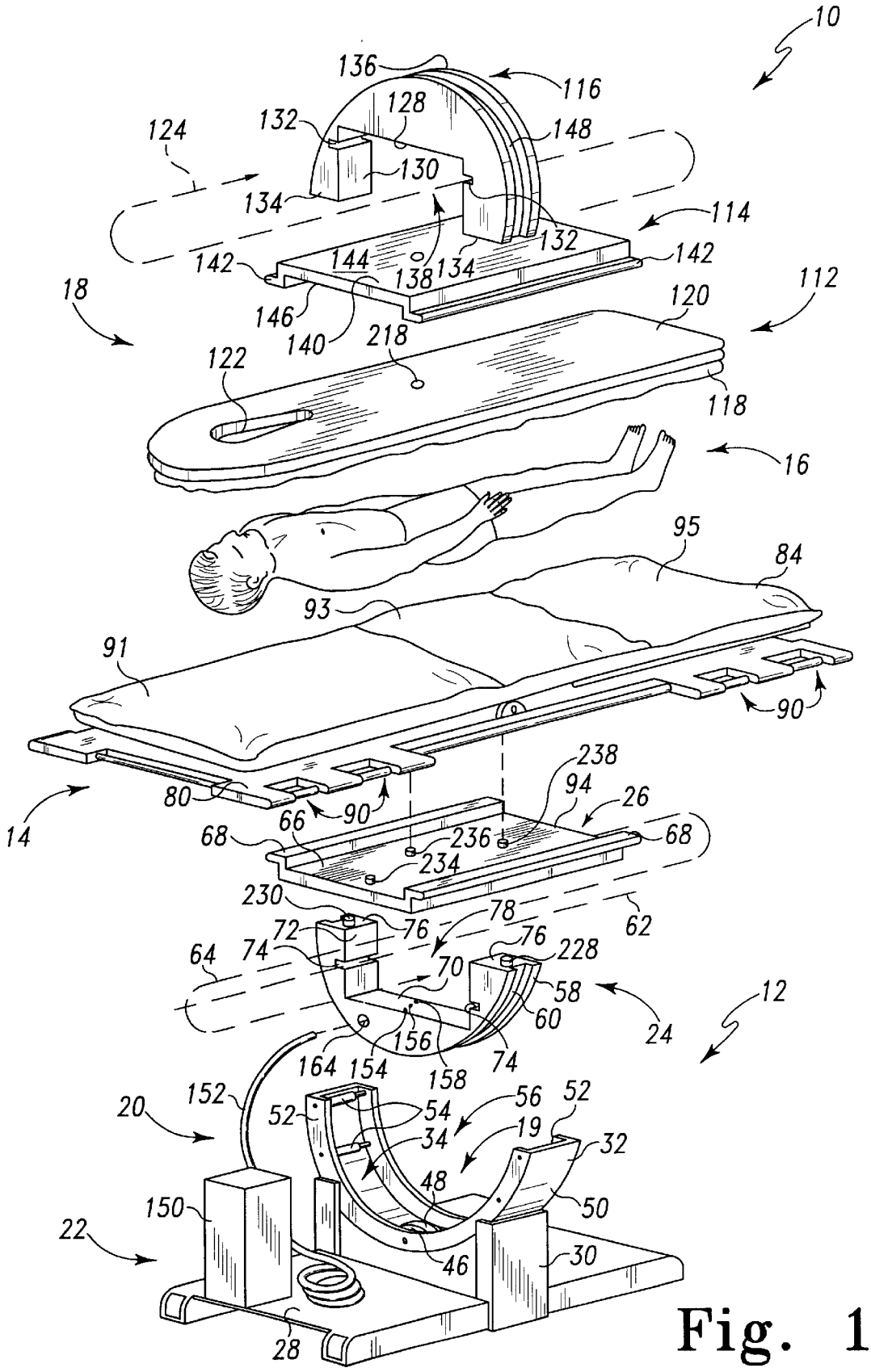
FIG. 1 is an exploded, perspective view of a proning bed having a posterior bed support, a patient support surface, and an anterior bed support.

A proning bed 10 is shown in FIGS. 1–4. The proning bed 10 includes a posterior bed support 12, a patient support surface 14 on which a patient 16 may lie, an anterior bed support 18, a mover 19 which moves patient support surface 14, and a fluid supply system 20 as shown in FIG. 1. The patient support surface 14 is releasably coupled to posterior bed support 12 so that a patient 16 may be transported on the same patient support surface 14 that is coupled to the posterior bed support 12. Thus, the patient 16 does not have to be moved onto a new support surface when placed on proning bed 10.

The fluid supply system 20 is in communication with the patient support surface 14 to provide a fluid to patient support surface 14 when surface 14 is coupled to posterior bed support 12. The posterior and anterior bed supports 12, 18 include passageways to enable the transfer of the fluid from fluid supply system 20 to patient support surface 14. In the illustrated embodiment, the fluid is air. In alternative embodiments, the fluid may be another gas, a liquid, a gel, beads, or other substances which can be used to inflate and deflate a bladder.

Figure 2:
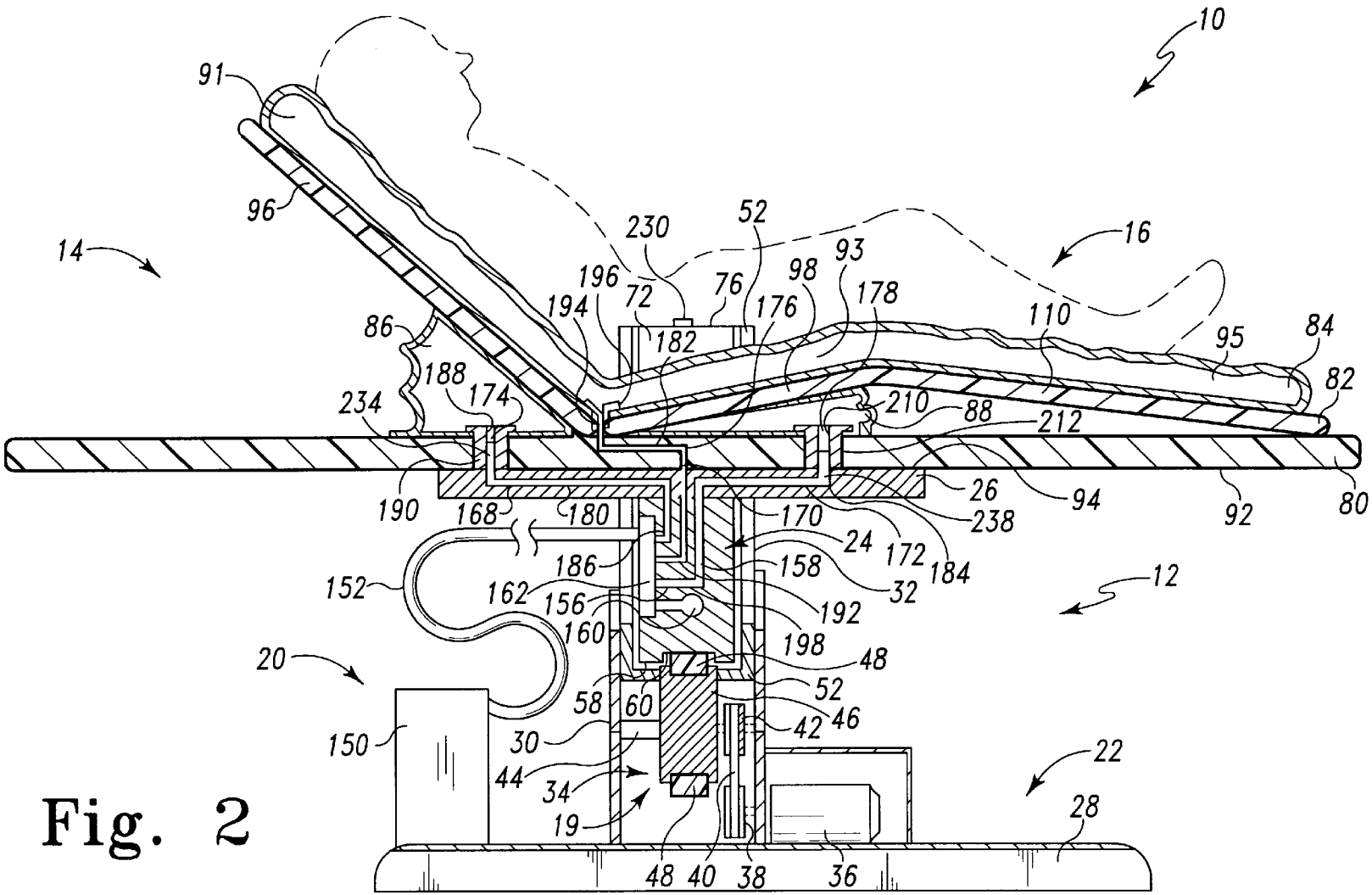
FIG. 2 is a sectional view of the proning bed of FIG. 1 showing the patient support surface coupled to the posterior bed support and a patient (in phantom) lying in an upright position on the patient support surface.
Figure 3:
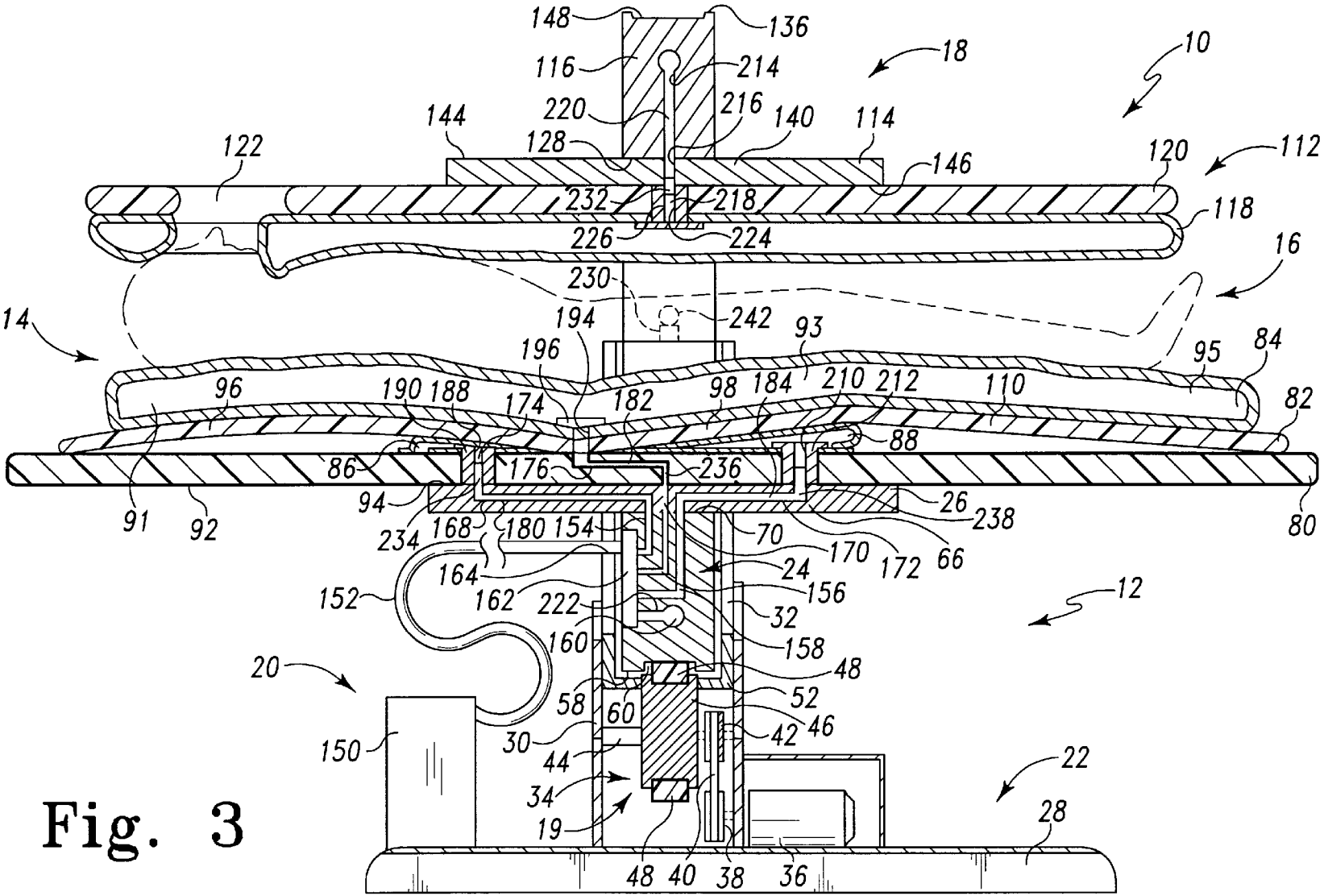
FIG. 3 is a sectional view similar to FIG. 2 showing the anterior bed support coupled to the posterior bed support and the patient lying in a horizontal position on the patient support surface between the posterior and anterior bed supports.
Figure 4:
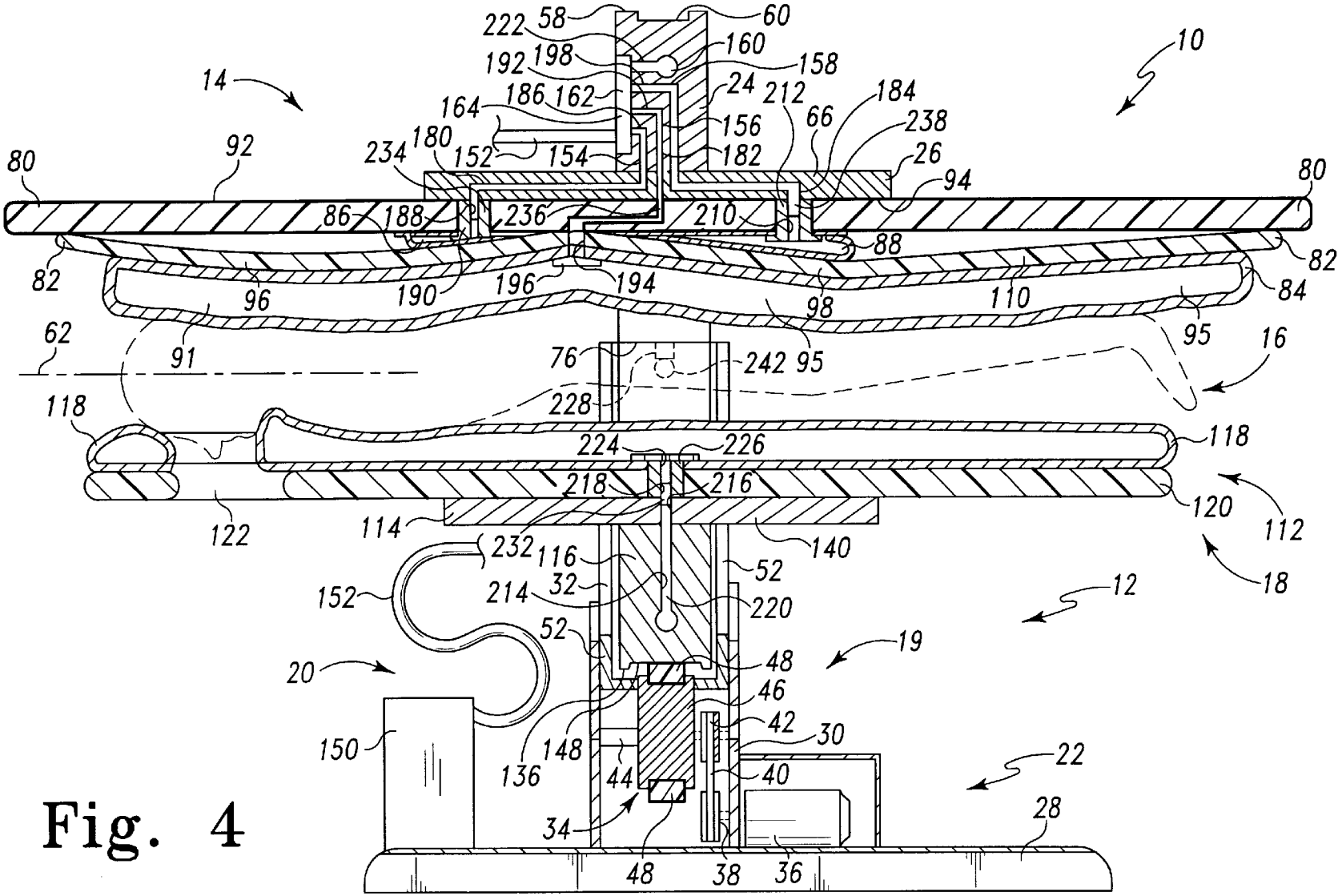
FIG. 4 is a sectional view similar to FIG. 3 showing the patient support surface of the proning bed rotated 180° to place the patient in a prone position.

The posterior bed support 12 includes a base 22, a posterior body portion 24, and a posterior support plate 26. The base 22 includes a foundation 28, a stand 30 coupled to foundation 28, and a stationary cradle 32 coupled to stand 30 as shown in FIGS. 3 and 4. The stand 30 includes an interior region 34 which houses mover 19 as shown in FIGS. 2–4. In the illustrated embodiment, the mover 19 includes a motor 36, a drive pulley 38, a driven pulley 42, a belt 40 which couples driven pulley 42 and drive pulley 38, and a shaft 44 coupled to driven pulley 42. The mover 19 further includes a metal hub 46 coupled to shaft 44 and a rubber ring 48 positioned around hub 46. Operation of the motor 36 rotates drive pulley 38 which, in turn, moves belt 40. Movement of belt 40 rotates driven pulley 42 which, in turn, rotates shaft 44, hub 46, and ring 48.

The stationary cradle 32 includes an outer wall 50, spaced-apart sidewalls 52 coupled to outer wall 50, and spaced-apart roller bearings 54 coupled to sidewalls 52. The sidewalls 52 define an opening 56 in which the spaced-apart roller bearings 54 and the rotating metal hub 46 with rubber ring 48 are positioned.

The posterior body portion 24 is also positioned in opening 56 of stationary cradle 32 and is in contact with roller bearings 54 and mover 19 as shown in FIGS. 2 and 3. The posterior body portion 24 includes an outer wall 58 defining a groove 60. The roller bearings 54 of stationary cradle 32 and the rubber ring 48 and metal hub 46 of the mover 19 are positioned in groove 60 so that the roller bearings 54 and ring 48 contact the outer wall 58 of posterior body portion 24 as shown in FIGS. 2 and 3. The contact between the ring 48 of mover 19 and the posterior body portion 24 permit mover 19 to rotate posterior body portion 24 about a horizontal axis 62. As the posterior body portion 24 is rotated by mover 19, the roller bearings 54 support posterior body portion 24.

In the illustrated embodiment, the ring 48 is made of rubber to enhance the mover's ability to rotate posterior body portion 24 by increasing the friction between hub 46 of mover 19 and outer wall 58 of posterior body portion 24. In alternative embodiments, the mover may be any mechanism which rotates the posterior body portion about a horizontal axis or moves the patient in a desired manner.

The posterior support plate 26 is configured to slide into the posterior body portion 24 as illustrated by dotted line 64 in FIG. 1. The posterior support plate 26 includes a central portion 66 and spaced-apart outer lips 68 coupled to central portion 66. The posterior body portion 24 further includes a central inner wall 70, spaced-apart inner side walls 72 extending upwardly from central inner wall 70, side notches 74 extending into each of the inner side walls 72, and spaced-apart upper walls 76 extending between inner side walls 72 and outer wall 58. Inner walls 70, 72 define a recess 78 in which support plate 26 is positioned.

When a caregiver slides support plate 26 into the posterior body portion 24, the outer lips 68 of the support plate 26 slide through the notches 74 of the posterior body portion 24. In their assembled position shown in FIGS. 2–4, the support plate 26 and posterior body portion 24 are coupled to each other by the outer lips 68 of support plate 26 lying in the notches 74 of posterior body portion 24. Another mechanism (not shown), such as a mating groove/detent mechanism, is provided to properly position and couple the support plate 26 and posterior body portion 24. Once the support plate 26 and posterior body portion 24 are coupled together, the central portion 66 of the posterior plate 26 is positioned on the central inner wall 70 of the posterior body portion 24.

The patient support surface 14 includes a backboard 80, an articulating platform 82 coupled to the backboard 80, a mattress 84, and first and second bellows 86, 88 as shown, for example, in FIG. 2. The backboard 80 of the patient support surface 14 includes a plurality of handle grips 90, as shown in FIG. 1, so that the patient support surface 14 can be carried easily from one area to another and thus used as a stretcher. The backboard 80 also includes a bottom surface 92 configured to abut an upper surface 94 of the posterior plate 26 when the patient support surface 14 is coupled to posterior bed support 12, as shown in FIGS. 2 and 3.

The patient support surface 14 further includes a head end 91, a central portion 93, and a foot end 95. When the patient support surface 14 is coupled to posterior bed support 12, the central portion 93 of the support surface 14 abuts the posterior bed support 12.

The articulating platform 82 and mattress 84 are moved into various positions by inflation and deflation of the bellows 86, 88. The inflation and deflation of the bellows 86, 88 is controlled by the fluid system 20.

The bellows 86, 88 are able to move the platform 82 and mattress 84 into various positions because the articulating platform 82 includes three portions that are pivotable relative to each other: a head portion 96, a central portion 98, and a foot portion 110. The first bellows 86 is positioned to lie between the head portion 96 of the platform 82 and the backboard 80 and, as shown in FIGS. 2 and 3, bellows 86 is inflated and deflated to raise and lower, respectively, the patient's head. The second bellows 88 is positioned between the central portion 98 of the articulating platform 82 and the backboard 80 and, as shown in FIGS. 2 and 3, bellows 88 may be inflated and deflated to raise and lower, respectively, the patient's knees.

The patient 16 rests on the mattress 84 as shown in FIGS. 2 and 3. The mattress 84 may be any type of conventional mattress and may include, for example, a plurality of separately controlled bladders that receive the fluid from fluid system 20 or a combination of bladders and any other resilient material, such as foam. The fluid system 20 provides a fluid to the bellows 86, 88 and the bladders in mattress 84 to inflate and deflate the bellows 86, 88 and mattress 84.

As shown in FIG. 2, when a patient 16 is lying on bed 10 in a conventional manner, only posterior bed support 12 and patient support surface 14 are required. When the patient 16 needs to be placed in a prone position as shown in FIG. 4, the anterior bed support 18 is coupled to the posterior bed support 12 as shown in FIG. 3.

The anterior bed support 18 includes a proning support surface 112, an anterior support plate 114, and an anterior body portion 116. The proning support surface 112 is provided to support a patient 16 lying in a prone position as shown in FIG. 4. The proning support surface 112 includes a mattress 118 and a proning platform 120 coupled to the mattress 118. A patient 16 lies on mattress 118 when in the prone position, as shown in FIG. 4, and the patient's face is received in an opening 122 formed in mattress 118 and platform 82. In the illustrated embodiment, the mattress 118 is an air mattress. As discussed above in reference to mattress 84 of posterior bed support 12, in alternative embodiments, the mattress of the anterior bed support may be any type of conventional mattress.

The anterior support plate 114 and anterior body portion 116 are similar to the posterior plate 26 and posterior body portion 24, respectively, as shown in FIG. 1. The anterior plate 114 is configured to slide into the anterior body portion 116 as shown by dotted line 124 in FIG. 1. The anterior body portion 116 includes a central inner wall 128, spaced-apart inner side walls 130 extending upwardly from central inner wall 128, side notches 132 extending into each of the inner side walls 130, spaced-apart upper walls 134, and an outer wall 136. The inner walls 128, 130 define a recess 138 in which support plate 114 is positioned.

The anterior support plate 114 includes a central portion 140 and spaced-apart outer lips 142 coupled to central portion 140. When a caregiver slides support plate 114 into the anterior body portion 116, the outer lips 142 of the support plate 114 slide through notches 132 of the anterior body portion 116. In their assembled position shown in FIGS. 3 and 4, the support plate 114 and anterior body portion 116 are coupled to each other by the outer lips 142 of support plate 114 lying in the notches 132 of anterior body portion 116. Another mechanism (not shown), such as a mating groove/detent mechanism, is provided to properly position and couple the support plate 114 and anterior body portion 116. The anterior plate 114 further includes a first surface 144 that abuts the central inner wall 128 of the anterior body portion 116 and a second surface 146 that is coupled to the proning platform 120 with suitable fasteners (not shown).

The posterior and anterior body portions 24, 116 may be coupled to each other, as shown in FIGS. 3 and 4, by a separate latching mechanism (not shown). When coupled together, the anterior and posterior body portions 24, 116 form a ring capable of being rotated 360° by mover 19 within the stationary cradle 32. The anterior body portion 116 includes a groove 148 defined by outer wall 136 of anterior body portion 116. The groove 148 of anterior body portion 116 cooperates with groove 60 of posterior body portion 24 to define a continuous groove extending 360° about the periphery of the ring formed by anterior and posterior body portions 24, 116.

The rubber ring 48 of mover 19 interacts with groove 148 of anterior body portion 116 in the same manner that it interacts with groove 60 of posterior body portion 24. The roller bearings 54 of stationary cradle 32 and the rotating rubber ring 48 surrounding the metal hub 46 of the mover 19 are capable of being positioned to lie in groove 148 such that the roller bearings 54 and ring 48 may contact the anterior body portion 116, as shown in FIG. 4. The mover 19 rotates anterior body portion 116 about horizontal axis 62 by the rotation of rubber ring 48 rotating anterior body portion 116. The roller bearings 54 support anterior body portion 116 as it is rotated by mover 19. As the posterior and anterior body portions 24, 116 are rotated, the mover 19 contacts one or both of the body portions 24, 116. As shown in FIGS. 2 and 3, the mover 19 contacts the posterior body portion 24 when the patient 16 is in a supine position and, as shown in FIG. 4, the mover 19 contacts the anterior body portion 116 when the patient 16 is in a prone position.

The fluid supply system 20 includes a fluid supply, blower or compressor 150 coupled to foundation 28 and a hose 152 coupled to fluid supply 150 as shown in FIGS. 1–4. The posterior and anterior bed supports 12, 18 and backboard 80 of the patient support surface 14 include several passageways to enable the delivery of fluid to patient support surface 14 and mattress 118 of anterior bed support 18. The posterior body portion 24 includes a plurality of passageways 154, 156, 158, 160, a fluid manifold 162, and an inlet aperture 164 opening into fluid manifold 162 as shown in FIGS. 1–4. The inlet aperture 164 is configured to receive the hose 152 and fluid is provided by fluid supply system 20 to fluid manifold 162 through inlet aperture 164. Depending on the need for fluid, fluid may travel through any of the passageways 154, 156, 158, 160 formed in posterior body portion 24.

The posterior plate 26 and backboard 80 also include a plurality of passageways 168, 170, 172 and 174, 176, 178, respectively, as shown in FIGS. 2–4. Three of the passageways 154, 156, 158 of the posterior body portion 24, passageways 168, 170, 172 of the posterior plate 26, and passageways 174, 176, 178 of backboard 80 cooperate to define pathways 180, 182, 184, respectively, that extend from fluid manifold 162 to bellows 86, 88 and mattress 84. Pathway 180 includes an inlet 186 opening into fluid manifold 162 and an outlet 188 opening into bellows 86 as shown in FIGS. 2–4. A seal 190 is positioned in the outlet 188 to seal the junction between pathway 180 and bellows 86. Pathway 182 includes an inlet 192 opening into fluid manifold 162 and an outlet 194 opening into mattress 84 as shown in FIGS. 2–4. A seal 196 is positioned in the outlet 194 to seal the junction between pathway 182 and mattress 84. Pathway 184 includes an inlet 198 opening into fluid manifold 162 and an outlet 210 opening into bellows 88 as shown in FIGS. 2–4. A seal 212 is positioned in the outlet 210 to seal the junction between pathway 184 and bellows 88.

The fourth passageway 160 of posterior body portion 24 is in communication with passageways 214, 216, 218 formed in anterior body portion 116, anterior support plate 114, and proning platform 120 of proning support surface 112. These passageways 160, 214, 216, 218 cooperate to define a pathway 220 through which fluid passes to inflate mattress 118 of proning support surface 112. Pathway 220 includes an inlet 222 opening into fluid manifold 162 and an outlet 224 opening into mattress 118 as shown in FIGS. 2–4. A seal 226 is positioned in the outlet 224 to seal the junction between pathway 220 and mattress 118.

The various passageways are aligned relative to each other to define pathways 180, 182, 184, 220 by providing nipples at certain locations in the pathways and using the mechanisms (not shown) discussed above to properly position and couple the posterior support plate 26 and posterior body portion 24 and the anterior support plate 114 and anterior body portion 116. In other preferred embodiments, additional mechanisms such as seals and nipples may be used to positively couple the various passageways.

Pathway 220 includes three nipples 228, 230, 232. Nipples 228, 230 are positioned on upper walls 76 of posterior body portion 24 as shown in FIGS. 1 and 2. The nipples 228, 230 are received in apertures (not shown) formed in anterior body portion 116 when anterior body portion 116 is coupled to posterior body portion 24. Nipple 232 is coupled to anterior support plate 114 and extends into seal 226 as shown in FIGS. 3 and 4. This nipple 232 assists in properly aligning anterior support plate 114 and proning platform 120.

The posterior plate 26 includes nipples 234, 236, 238 coupled to central portion 66 of posterior plate 26 as shown in FIG. 1. Nipples 234, 238 extend into seals 190, 212 and nipple 236 extends into passageway 176 of backboard 80 and as shown in FIGS. 2–4. The nipples 234, 236, 238 assist in properly aligning patient support surface 14 and posterior plate 26 of posterior bed support 12 and in sealing pathways 180, 182, 184.

In the illustrated embodiment, a single pathway 182 is in communication with mattress 84 of patient support surface 14 and a single pathway 220 is in communication with mattress 118 of anterior bed support 18. In other preferred embodiments, multiple passageways may be in communication with the mattresses so that various zones of the mattresses may separately inflated and deflated.

The fluid supply system 20 further includes a control system (not shown) that controls the flow of fluid into mattresses 84, 118 and bellows 86, 88. The control system permits a user such as a patient or caregiver to inflate and deflate the mattresses 84, 118 and bellows 86, 88 as needed. A control system that can be used is disclosed in U.S. patent application Ser. No. 09/281,888 entitled "Air Over Foam Mattress", which is expressly incorporated by reference herein.

As shown in FIG. 3, the anterior body portion 116 also includes valves 242 positioned to lie in passageway 214. The valves 242 are normally in a closed position. When the nipples 228, 230 coupled to the posterior body portion 24 mate with the anterior body portion 116, the valves 242 are opened to permit fluid to flow into the anterior bed support 18. Once fluid is permitted to flow from the posterior bed support 12 to the anterior bed support 18, it flows through the passageways 214, 216, 218 formed in the anterior body portion 116, anterior support plate 114, and proning platform 120 into the mattress 118 of the proning support surface 112.

The proning bed 10 may be used to support a patient 16 in a conventional manner as shown in FIG. 2 wherein no portion of the anterior bed support 18 (proning support surface 112, anterior plate 114, and anterior body portion 116) is coupled to the posterior bed support 12. In this configuration, the bellows 86, 88 are used to raise and lower the patient's head and knees as shown in FIG. 2. Further, in this configuration, the control system prevents the flow of fluid through passageway 160 as the passageway 160 is open at nipples 228, 230.

To rotate the patient 16 to a prone position, as shown in FIG. 4, the anterior bed support 18 is coupled to the posterior bed support 12. The patient 16 may be placed in a prone position for several purposes including, performing certain surgical procedures on the spine or simply permitting the patient 16 to lie face down on the proning support surface 112 for therapy. The anterior bed support 18 is coupled to the posterior bed support 12 by a mechanism (not shown). Once the posterior and anterior bed supports 12, 18 are coupled together, as shown in FIG. 3, the mover 19 rotates the anterior and posterior body portions 24, 116 about horizontal axis 62. Further, once the posterior and anterior bed supports 12, 18 are coupled together, the control system permits the flow of fluid through passageway 160 and the valve 242 in anterior body portion 116 opens to permit fluid to travel from fluid manifold 162 to mattress 118 of anterior bed support 18.

Once the patient 16 is in a prone position, the posterior body portion 24, posterior support plate 26, and patient support surface 14 are removed so that a caregiver has access to the patient 16. When these structures 14, 24, 26 are removed, the valves 242 of anterior body portion 116 close so that the fluid contained in passageways 214, 216, 218 and mattress 118 of anterior bed support 18 remains in place and the mattress 118 will retain a certain inflated or deflated position. Because the fluid supply system 20 is separated from the mattress 118 of anterior bed support 18 when these structures 14, 24, 26 are removed, the caregiver should inflate or deflate the mattress 118 to a desired position before the structures 14, 24, 26 are removed. In the preferred embodiment, the fluid used to inflate and deflate mattresses 84, 118 and bellows 86, 88 is air. In alternative embodiments where the fluid is different, additional valves may be required to enable fluid to be properly drained and/or stored when these structures are removed.

The proning bed 10 provides mattresses 84, 118 as part of patient support surface 14 and anterior bed support 18, respectively. These mattresses 84, 118 may be inflated and deflated by the fluid supply system 20. The mattress 84 of patient support surface 14 is inflated when and/or after patient support surface 14 is coupled to posterior bed support 12. In alternative embodiments, the mattress of the patient support surface may be fully or partially inflated before the patient support surface is coupled to the posterior bed support to provide comfort for the patient as the patient is transferred to the proning bed from an ambulance, accident location, etc. When the patient 16 is lying on the mattress 84 in a supine position, the anterior bed support 18 is coupled to the posterior bed support 12 as shown in FIG. 3. The mattress 118 of anterior bed support 18 is then inflated before the mover 19 rotates the patient 16 such that the patient 16 is lying on mattress 118 of anterior bed support 18 in a prone position as shown in FIG. 4. Once the patient 16 is in this prone position, the mattress 84 of the patient support surface 14 is deflated and removed to provide access to the back side of the patient 16.

In alternative embodiments, the hose of the fluid supply system may be moved from the posterior bed support to the anterior bed support when the posterior support structures and the patient support surface are removed to permit access to a patient lying in a prone position. In another alternative embodiment, the fluid supply system may include multiple hoses wherein a hose is coupled to the posterior bed support and another hose is coupled to the anterior bed support. In each of these alternative embodiments, the anterior bed support includes an inlet aperture which receives the hose and a passageway extending from the inlet aperture to the existing passageway in the anterior bed support so that the fluid supply system is in communication with the mattress of the anterior bed support. In each of these alternative embodiments, the mattress of the anterior bed support can be inflated and deflated even after the posterior bed support structures and the patient support surface are removed because the fluid supply system remains in communication with the mattress when these structures are removed.

Figure 5:
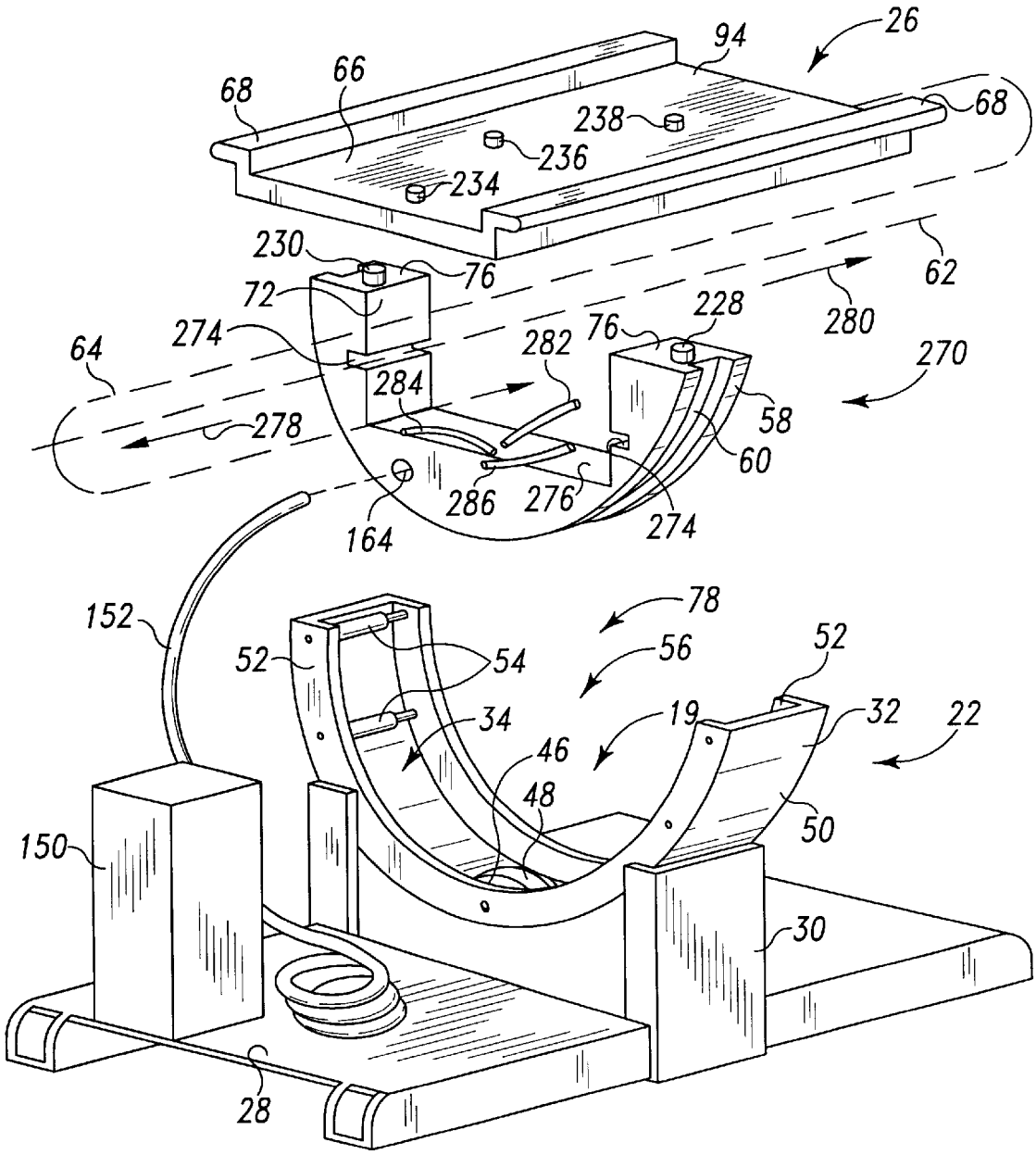
FIG. 5 is an exploded, perspective view of an alternative embodiment of a posterior bed support of a proning bed.

An alternative embodiment of a posterior bed support 260 is shown in FIG. 5. The posterior bed support 260 includes a posterior body portion 270, a base 22, and a posterior support plate 26. The base 22 and posterior support plate 26 are identical in posterior bed supports 12, 260 and are numbered identically.

The posterior body portion 270 includes inner side walls 272, side notches 274 formed in inner side walls 272, and a central inner wall 276. The only difference between posterior body portions 24, 270 is that the notches 274 in side walls 272 of posterior body portion 270 are spaced-apart from central inner wall 276 by a distance that is greater than the distance between notches 74 and central inner wall 70 of posterior body portion 24. All other components of posterior body portions 24, 270 are identical and thus are numbered identically.

The posterior support plate 26 slides into notches 274 of posterior body portion 270 in the same manner as it slides into notches 74 of the posterior body portion 24. When support plate 26 slides into notches 74 of posterior body portion 24, the lower surface of the support plate 26 contacts the central inner wall 70 as shown in FIGS. 2–4. In contrast, when posterior support plate 26 slides into notches 274 of posterior body portion 24, the larger distance between notches 274 and central inner wall 276 of posterior body portion 270 provides a gap between the lower surface of posterior support plate 26 and central inner wall 276 of posterior body portion 270. This gap permits posterior support plate 26 and the attached patient support surface 14 to slide in directions 278, 280 relative to base 22. This sliding movement of plate 26 and patient support surface 14 permits better access to certain parts of patient 16 so that certain procedures such as x-rays and MRI's can be performed.

Flexible hoses 282, 284, 286 are coupled to passageways 154, 156, 158, respectively, of posterior body portion 24 and passageways 168, 170, 172, respectively, of posterior support plate 26. These hoses 282, 284, 286 comprise part of pathways 180, 182, 184 and ensure that these pathways 180, 182, 184 are not interrupted when plate 26 and patient support surface 14 slide in directions 278, 280.

In alternative embodiments of anterior bed supports, the anterior body portion is similar to posterior body portion 270 in that a gap exists between the lower surface of the anterior support plate and the central inner wall of the anterior body portion. This gap permits the anterior support plate and the proning support surface on which a patient lies in a prone position to slide relative to the anterior body portion. The sliding motion of the proning support surface when the patient is lying in a prone position permits better access to certain parts of the patient so that certain procedures such as x-rays and MRI's can be performed. Flexible hoses are coupled to the fluid passageways of the anterior body portion and anterior support to ensure that the fluid pathways are not interrupted when the anterior support plate and proning support surface slide relative to the anterior body portion.

Although the invention has been described with reference to several embodiments, variations, and modification exist within the scope and spirit of the invention as described.

What is claimed is:

1. A bed comprising:

a fluid supply, a bed support coupled to the fluid supply, and a patient support surface configured to couple to and be separated from the bed support, the patient support surface being in communication with the fluid supply automatically when the patient support surface is coupled to the bed support.

2. The bed of claim 1, further comprising a mover configured to rotate the patient support surface about a longitudinal axis of the patient support surface.

3. The bed of claim 1, wherein the patient support surface includes a mattress and the fluid supply is in communication with the mattress when the patient support surface is coupled to the bed support.

4. The bed of claim 1, wherein the patient support surface includes a mattress, a bellows, and an articulating platform positioned between the bellows and mattress, the fluid supply is in communication with the mattress and the bellows when the patient support surface is coupled to the bed support.

5. The bed of claim 1, further comprising a mover and an anterior bed support coupled to the bed support, the anterior bed support including a mattress, and the mover being configured to move the patient support surface and mattress of the anterior bed support.

6. The bed of claim 5, wherein the anterior bed support includes a passageway having an inlet and an outlet, the inlet of the passageway of the anterior bed support being in communication with the fluid supply, and the mattress of the anterior bed support being in communication with the outlet of the passageway so that the fluid supply inflates the mattress.

7. The bed of claim 6, wherein the patient support surface includes a mattress and the fluid supply is in communication with the mattress when the patient support surface is coupled to the bed support.

8. The bed of claim 5, wherein the fluid supply is in communication with the mattress of the anterior bed support when the anterior bed support is coupled to the bed support.

9. The bed of claim 1, wherein the patient support surface includes spaced-apart head and foot ends and a central portion extending between the head and foot ends and the central portion of the patient support surface is coupled to the bed support.

10. The bed of claim 1, wherein the bed support includes a passageway having an inlet and an outlet, the fluid supply is coupled to the inlet of the passageway, and the patient support surface is in communication with the outlet of the passageway of the bed support when the patient support surface is coupled to the bed support.

11. The bed of claim 10, further comprising an anterior bed support coupled to the bed support, the anterior bed support including a mattress and a passageway having an inlet in communication with the passageway of the bed support and an outlet in communication with the mattress of the anterior bed support.

12. The bed of claim 1, wherein the bed support includes a body portion and a support plate movably coupled to the body portion, the patient support surface being coupled to the support plate.

13. The bed of claim 12, further comprising a plurality of fluid supply hoses coupled between the body portion and the support plate to supply fluid to the patient support surface.

14. The bed of claim 12, wherein the bed support further includes a base, a cradle coupled to the base, and a plurality of bearings coupled to the cradle to support the body portion, and further comprising a mover configured to rotate the body portion, the support plate, and the patient support surface about a longitudinal axis of the patient support surface.

15. The bed of claim 1, further comprising an anterior bed support including an anterior body portion, an anterior support plate coupled to the anterior body portion, and a proning support surface coupled to the anterior support plate.

16. The bed of claim 15, wherein the proning support surface includes a mattress coupled to the fluid supply through the anterior body portion and the anterior support plate.

17. A bed comprising:

a patient support surface, a bed support, a fluid supply coupled to the bed support, and means for releasably coupling the patient support surface and the bed support so that the fluid supply is in communication with the patient support surface when the patient support surface is coupled to the bed support.

18. The bed of claim 17, further comprising an anterior bed support coupled to the bed support.

19. The bed of claim 18, further comprising a proning support surface coupled to the anterior bed support, and a mover configured to rotate the patient support surface, the anterior bed support, and the proning surface.

20. The bed of claim 19, wherein the proning support surface includes a mattress coupled to the fluid supply through the anterior bed support.

21. The bed of claim 17, further comprising a mover configured to rotate the patient support surface about a longitudinal axis of the patient support surface.

22. The bed of claim 17, wherein the patient support surface includes a mattress and the fluid supply is in communication with the mattress when the patient support surface is coupled to the bed support.

23. The bed of claim 17, further comprising a mover and an anterior bed support coupled to the bed support, the anterior bed support including a mattress, and the mover being configured to move the patient support surface and mattress of the anterior bed support.

24. The bed of claim 17, wherein the bed support includes a body portion and a support plate movably coupled to the body portion, the patient support surface being coupled to the support plate.

25. The bed of claim 24, wherein the bed support further includes a base, a cradle coupled to the base, and a plurality of bearings coupled to the cradle to support the body portion, and further comprising a mover configured to rotate the body portion, the support plate, and the patient support surface about a longitudinal axis of the patient support surface.

26. A bed comprising:

a fluid supply, a posterior bed support coupled to the fluid supply, an anterior bed support coupled to the posterior bed support, the anterior bed support including a mattress, and a patient support surface coupled to the posterior bed support, the patient support surface and the mattress of the anterior bed support being in communication with the fluid supply when the patient support surface is coupled to the posterior bed support.

27. The bed of claim 26, wherein the posterior bed support includes a posterior body portion and a posterior support plate coupled to the posterior body portion, the patient support surface being coupled to the posterior support plate.

28. The bed of claim 27, wherein the posterior bed support further includes a base, a cradle coupled to the base, and a plurality of bearings coupled to the cradle to support the posterior body portion, and further comprising a mover configured to rotate the posterior body portion, the posterior support plate, and the patient support surface about a longitudinal axis of the patient support surface.

29. The bed of claim 28, wherein the mover is configured to rotate the posterior body portion and the anterior bed support about the longitudinal axis so that the anterior bed support is received within the cradle and supported on the bearings.

30. The bed of claim 26, wherein the anterior bed support includes an anterior body portion, an anterior support plate coupled to the anterior body portion, and a proning support surface coupled to the anterior support plate.

31. The bed of claim 30, wherein the proning support surface includes a mattress coupled to the fluid supply through the anterior body portion and the anterior support plate.

32. A bed comprising:

a posterior bed support, the posterior bed support including a passageway having an inlet and an outlet, a patient support surface coupled to the posterior bed support, the patient support surface including a mattress that is in communication with the outlet of the passageway of the posterior bed support when the patient support surface is coupled to the posterior bed support, an anterior bed support coupled to the posterior bed support, the anterior bed support including a passageway and a mattress in communication with the passageway, the passageways of the anterior and posterior bed supports being in communication when the anterior bed support is coupled to the posterior bed support, and a fluid supply coupled to the inlet of the passageway of the posterior bed support.

33. The bed of claim 32, wherein the patient support surface is configured to be coupled to and be separated from the posterior bed support, the patient support surface being in communication with the outlet of the passageway of the posterior bed support automatically when the patient support surface is coupled to the posterior bed support.

34. The bed of claim 32, wherein the posterior bed support includes a posterior body portion and a posterior support plate coupled to the posterior body portion, the patient support surface being coupled to the posterior support plate.

35. The bed of claim 34, wherein the posterior bed support further includes a base, a cradle coupled to the base, and a plurality of bearings coupled to the cradle to support the posterior body portion, and further comprising a mover configured to rotate the posterior body portion, the posterior support plate, and the patient support surface about a longitudinal axis of the patient support surface.

36. The bed of claim 35, wherein the mover is configured to rotate the posterior body portion and the anterior bed support about the longitudinal axis so that the anterior bed support is received within the cradle and supported on the bearings.

37. The bed of claim 32, wherein the anterior bed support includes an anterior body portion, an anterior support plate coupled to the anterior body portion, and a proning support surface coupled to the anterior support plate.

38. The bed of claim 37, wherein the proning support surface includes a mattress coupled to the fluid supply through the anterior body portion and the anterior support plate.

39. A method for handling a patient on a bed, the method comprising the steps of:

providing a bed support supporting a fluid passageway having an inlet and an outlet;

coupling a fluid supply to the inlet of the fluid passageway of the bed support; and coupling a patient support surface to the bed support, the patient support surface being in fluid communication with the fluid supply through the outlet of the fluid passageway automatically when the patient support surface is coupled to the bed support.

40. The method of claim 39, further comprising the steps of:

coupling an anterior bed support to the bed support, the anterior bed support including a mattress; and moving the patient support surface and the mattress of the anterior bed support.

41. The method of claim 40, wherein the step of moving comprises rotating the patient support surface and the mattress of the anterior bed support about a longitudinally extending axis, so that a person lying on the mattress of the anterior bed support is in a prone position.

42. The method of claim 41, further comprising the step of removing the patient support surface after rotating the patient support surface and the mattress of the anterior bed support.

43. The method of claim 39, wherein the patient support surface includes a fluid passageway having an inlet, and the step of coupling the patient support surface to the bed support includes the step of aligning the outlet of the fluid passageway of the bed support with the inlet of the fluid passageway of the patient support surface.

44. The method of claim 39, further comprising the step of inflating the patient support surface.

45. The method of claim 44, further comprising the step of deflating the patient support surface.

46. The method of claim 44, further comprising the steps of inflating the mattress of the anterior patient support, and moving the patient support surface and the mattress.

* * * * *